US009982455B2

(12) United States Patent
Badhya et al.

(10) Patent No.: US 9,982,455 B2
(45) Date of Patent: May 29, 2018

(54) SIDE MOUNTED PRIVACY LOCK FOR A RESIDENTIAL DOOR

(71) Applicant: Schlage Lock Company LLC, Indianapolis, IN (US)

(72) Inventors: Rohith Badhya, Karnataka (IN); Sajil J. Mathachan, Karnataka (IN); Mohammed M. Ali, Karnataka (IN); Nimbennappa Gani, Karnataka (IN); Mayur Anandache, Karnataka (IN)

(73) Assignee: Schlage Lock Company LLC, Indianapolis, IN (US)

( * ) Notice: Subject to any disclaimer, the term of this patent is extended or adjusted under 35 U.S.C. 154(b) by 305 days.

(21) Appl. No.: 13/738,547

(22) Filed: Jan. 10, 2013

(65) Prior Publication Data

US 2014/0191516 A1 Jul. 10, 2014

(51) Int. Cl.
*E05C 1/04* (2006.01)
*E05B 13/00* (2006.01)
(Continued)

(52) U.S. Cl.
CPC ..... *E05B 13/004* (2013.01); *E05B 55/005* (2013.01); *E05B 37/163* (2013.01); *E05C 1/163* (2013.01); *Y10T 292/1022* (2015.04)

(58) Field of Classification Search
CPC . E05C 1/04; E05C 9/1841; E05C 1/12; E05C 1/10; E05C 1/14; E05C 3/041;
(Continued)

(56) References Cited

U.S. PATENT DOCUMENTS 224,040 A * 2/1880 Prouty ..... E05B 85/22 292/166
545,665 A * 9/1895 Barney ..... E05B 37/163 70/220

(Continued)

FOREIGN PATENT DOCUMENTS

KR 100576809 B1 5/2006
KR 200131810 Y1 11/2006
WO 2009/128100 10/2009

OTHER PUBLICATIONS

PCT Search Report and Written Opinion for PCT Application No. PCT/US2014/011038 dated May 8, 2014 (15 pages).

*Primary Examiner* — Kristina Fulton
*Assistant Examiner* — Faria Ahmad
(74) *Attorney, Agent, or Firm* — Michael Best & Friedrich LLP

(57) ABSTRACT

A door lock includes a latch assembly positioned at least partially within the door and movable between an engaged position in which the door is held in a closed position and a disengaged position in which the door is movable from a closed position to an open position. An outside spindle is rotatable about an axis and an inside spindle is rotatable about the axis to move the latch assembly between the engaged position and the disengaged position. A locking plate is movable along the axis between a locked position in which the outside spindle is fixed and an unlocked position in which the outside spindle and the inside spindle are each rotatable and a privacy lock actuator positioned on the inside of the door and movable in a direction substantially normal to the axis to move the locking plate between the locked position and the unlocked position.

22 Claims, 12 Drawing Sheets

(51) Int. Cl.

| | |
|---|---|
| ***E05B 55/00*** | (2006.01) |
| *E05C 1/12* | (2006.01) |
| *E05B 3/00* | (2006.01) |
| *E05B 37/16* | (2006.01) |
| *E05C 1/16* | (2006.01) |

(58) Field of Classification Search

CPC ..... E05C 3/042; E05C 3/043; E05C 3/044; E05C 3/047; E05B 13/002; E05B 41/00; E05B 1/003; E05B 1/0038; E05B 1/0046; E05B 1/0053; E05B 1/0092; E05B 2001/0076; E05B 3/00; E05B 85/18; E05B 85/14; Y10T 29/49895; Y10T 16/61; Y10T 24/44017; Y10T 29/49826; Y10T 29/49947; Y10T 29/53004; Y10T 403/5781

USPC .... 292/145, 166, 336.3, 359, 358, 347, 348; 70/134, 153, 379 R, 487, 143, 483–485, 70/379 A, 380, 150, 151 R, 151 A, 70/DIG. 6, DIG. 20, DIG. 7, DIG. 9, 70/DIG. 27, DIG. 33, DIG. 42

See application file for complete search history.

(56) References Cited

U.S. PATENT DOCUMENTS

| | | | | | |
|---|---|---|---|---|---|
| 545,666 | A | * | 9/1895 | Barney et al. | E05B 37/163 70/220 |
| 545,667 | A | * | 9/1895 | Barney | E05B 37/163 70/220 |
| 545,668 | A | * | 9/1895 | Barney | E05B 37/163 70/220 |
| 17,784 | A | | 9/1897 | Hill | |
| 721,322 | A | | 2/1903 | Oberholtzer | |
| 729,151 | A | | 5/1903 | Flora et al. | |
| 1,103,116 | A | * | 7/1914 | Wehner | E05B 37/16 70/214 |
| 1,133,437 | A | * | 3/1915 | Holt | E05B 85/22 292/153 |
| 1,179,683 | A | * | 4/1916 | Vajda | E05C 9/043 292/36 |
| 1,237,906 | A | * | 8/1917 | Hipp | E05B 37/16 70/187 |
| 1,270,372 | A | * | 6/1918 | Breirather | E05B 37/16 70/214 |
| 1,494,418 | A | | 5/1924 | Grahlfs | |
| 1,530,861 | A | * | 3/1925 | Standen | E05B 37/16 70/214 |
| 2,128,002 | A | | 8/1938 | Lebeau | |
| 2,264,420 | A | * | 12/1941 | Voight | E05C 1/163 292/359 |
| 2,295,435 | A | * | 9/1942 | Teich | E05C 1/163 292/359 |
| 2,400,403 | A | * | 5/1946 | Falk | E05C 1/163 292/169.17 |
| 2,499,948 | A | * | 3/1950 | Egor | E05C 1/163 292/359 |
| 2,504,483 | A | * | 4/1950 | Abraham | E05C 1/14 292/153 |
| 2,547,546 | A | * | 4/1951 | Stulpin | E05C 1/14 292/150 |
| 2,638,770 | A | | 5/1953 | Gutman | |
| 2,723,874 | A | * | 11/1955 | Hillgren | E05C 1/163 292/169.17 |
| 2,766,606 | A | * | 10/1956 | Whitehead | E05B 37/08 70/133 |
| 2,796,272 | A | * | 6/1957 | Quinn | E05C 5/00 292/207 |
| 3,160,432 | A | | 12/1964 | Crepinsek | |
| 3,447,347 | A | * | 6/1969 | Kawamura | E05B 37/163 70/157 |
| 3,616,667 | A | * | 11/1971 | McGourty | E05B 37/163 70/285 |
| 3,751,951 | A | | 8/1973 | Gridley | |
| 3,808,849 | A | | 5/1974 | Alexander | |
| 3,869,161 | A | * | 3/1975 | Meroni | E05B 55/005 292/166 |
| 4,027,508 | A | * | 6/1977 | McGourty | E05B 37/166 70/214 |
| 4,142,748 | A | * | 3/1979 | Hook | E05B 3/065 292/169.15 |
| 4,476,698 | A | | 10/1984 | Treslo | |
| 4,572,556 | A | | 2/1986 | Foshee | |
| 4,640,110 | A | * | 2/1987 | Fish | E05B 37/16 70/214 |
| 4,742,748 | A | * | 5/1988 | Tateishi | G10H 1/186 84/477 R |
| 4,861,084 | A | * | 8/1989 | Ozagir | E05B 13/004 292/359 |
| 4,901,545 | A | * | 2/1990 | Bacon | E05B 13/10 70/207 |
| 5,081,856 | A | | 1/1992 | Hsu | |
| 5,083,823 | A | * | 1/1992 | Fann | E05B 3/065 292/150 |
| 5,433,497 | A | * | 7/1995 | Koenig | E05B 13/002 292/169.14 |
| 5,544,507 | A | | 8/1996 | Lin | |
| 5,598,726 | A | | 2/1997 | Cordle | |
| 5,712,626 | A | | 1/1998 | Andreou | |
| 5,784,909 | A | | 7/1998 | Huang | |
| 5,826,924 | A | * | 10/1998 | Huang | E05B 13/004 292/169.14 |
| 5,909,919 | A | * | 6/1999 | Wang | E05B 13/004 292/169.15 |
| 5,927,777 | A | | 7/1999 | Kuo et al. | |
| 6,145,358 | A | * | 11/2000 | Wu | E05B 13/004 70/381 |
| 6,216,500 | B1 | | 4/2001 | Kang | |
| 6,297,725 | B1 | | 10/2001 | Tischendorf et al. | |
| 6,729,169 | B2 | * | 5/2004 | Moore | E05B 63/0065 70/149 |
| 7,530,245 | B2 | * | 5/2009 | Fan | E05B 63/18 292/359 |
| 7,748,244 | B2 | * | 7/2010 | Garza | E05B 63/0017 292/166 |
| 7,963,134 | B2 | * | 6/2011 | Rafferty | E05B 13/00 192/69.8 |
| D646,149 | S | | 10/2011 | Roberts, III | |
| 2002/0066297 | A1 | | 6/2002 | Wu et al. | |
| 2002/0166354 | A1 | * | 11/2002 | Moore | E05B 63/0065 70/134 |
| 2009/0056392 | A1 | | 3/2009 | Brannaman et al. | |
| 2012/0267903 | A1 | | 10/2012 | Welsby et al. | |
| 2014/0191516 | A1 | * | 7/2014 | Badhya | E05B 13/004 292/145 |
| 2015/0013401 | A1 | * | 1/2015 | Yoon | E05B 59/00 70/101 |
| 2015/0345175 | A1 | * | 12/2015 | Ali | E05C 1/163 292/358 |

* cited by examiner

SIDE MOUNTED PRIVACY LOCK FOR A RESIDENTIAL DOOR

BACKGROUND

The present invention relates to privacy locks for residential doors. More specifically, the present invention relates to privacy locks for residential doors that are mounted to the lock chassis rather than to the knob or lever.

SUMMARY

In one construction, the invention provides a door lock for a door that separates an inside from an outside and that includes a privacy function. The door lock includes a latch assembly positioned at least partially within the door and movable between an engaged position in which the door is held in a closed position and a disengaged position in which the door is movable from the closed position to an open position. The door lock also includes an inside housing fixedly coupled to an inside surface of the door, an outside housing fixedly coupled to an outside surface of the door, and an outside actuator rotatable about an axis to selectively move the latch assembly between the engaged position and the disengaged position. An inside actuator is rotatable about the axis to selectively move the latch assembly between the engaged position and the disengaged position and a privacy selector extending from the inside housing and movable in a direction normal to the axis between an open position in which the outside actuator is rotatable to actuate the latch assembly and a privacy position in which the outside actuator is fixed with respect to the outside housing and cannot actuate the latch assembly.

In another construction, the invention provides a door lock for a door that separates an inside from an outside and that includes a privacy function. The door lock includes a latch assembly positioned at least partially within the door and movable between an engaged position in which the door is held in a closed position and a disengaged position in which the door is movable from a closed position to an open position. An outside spindle is rotatable about an axis and an inside spindle is rotatable about the axis to move the latch assembly between the engaged position and the disengaged position. A locking plate is movable along the axis between a locked position in which the outside spindle is fixed with respect to the axis and an unlocked position in which the outside spindle and the inside spindle are each rotatable about the axis to move the latch assembly, and a privacy lock actuator positioned on the inside of the door and movable in a direction substantially normal to the axis to move the locking plate between the locked position and the unlocked position.

In yet another construction, the invention provides a door lock for a door that separates an inside from an outside and that includes a privacy function. The door lock includes a latch assembly positioned at least partially within the door and movable between an engaged position in which the door is held in a closed position and a disengaged position in which the door is movable from a closed position to an open position. An inside housing is fixedly coupled to an inside surface of the door and an outside housing is fixedly coupled to an outside surface of the door. A privacy locking mechanism is disposed substantially within the outside housing such that a substantial portion of the privacy locking mechanism is disposed nearer to the outside surface of the door than to the inside surface of the door. The privacy locking mechanism is operable in an open position to allow operation of the latch assembly from inside and outside of the door and a privacy position in which operation of the latch assembly from outside of the door is inhibited. A privacy selector extends from the inside housing and is movable in a direction substantially parallel to the inside surface of the door to move the privacy locking mechanism between the open position and the privacy position.

In another construction, the invention provides a method of converting a privacy lock for a door to a passage lock. The method includes connecting a lock housing to the door, providing a latch assembly positioned at least partially within the door and movable between an engaged position in which the door is held in a closed position and a disengaged position in which the door is movable from a closed position to an open position, and positioning a privacy locking mechanism substantially within the lock housing. The privacy locking mechanism operable in an open position to allow operation of the latch assembly from inside and outside of the door and a privacy position in which operation of the latch assembly from outside of the door is inhibited. The method also includes connecting a privacy selector to the privacy locking mechanism, the privacy selector including a selector interface disposed substantially outside of the lock housing and movable to move the privacy locking mechanism to one of the privacy position and the open position and removing the selector interface from the privacy selector to prevent a user from moving the privacy locking mechanism from the open position to the privacy position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
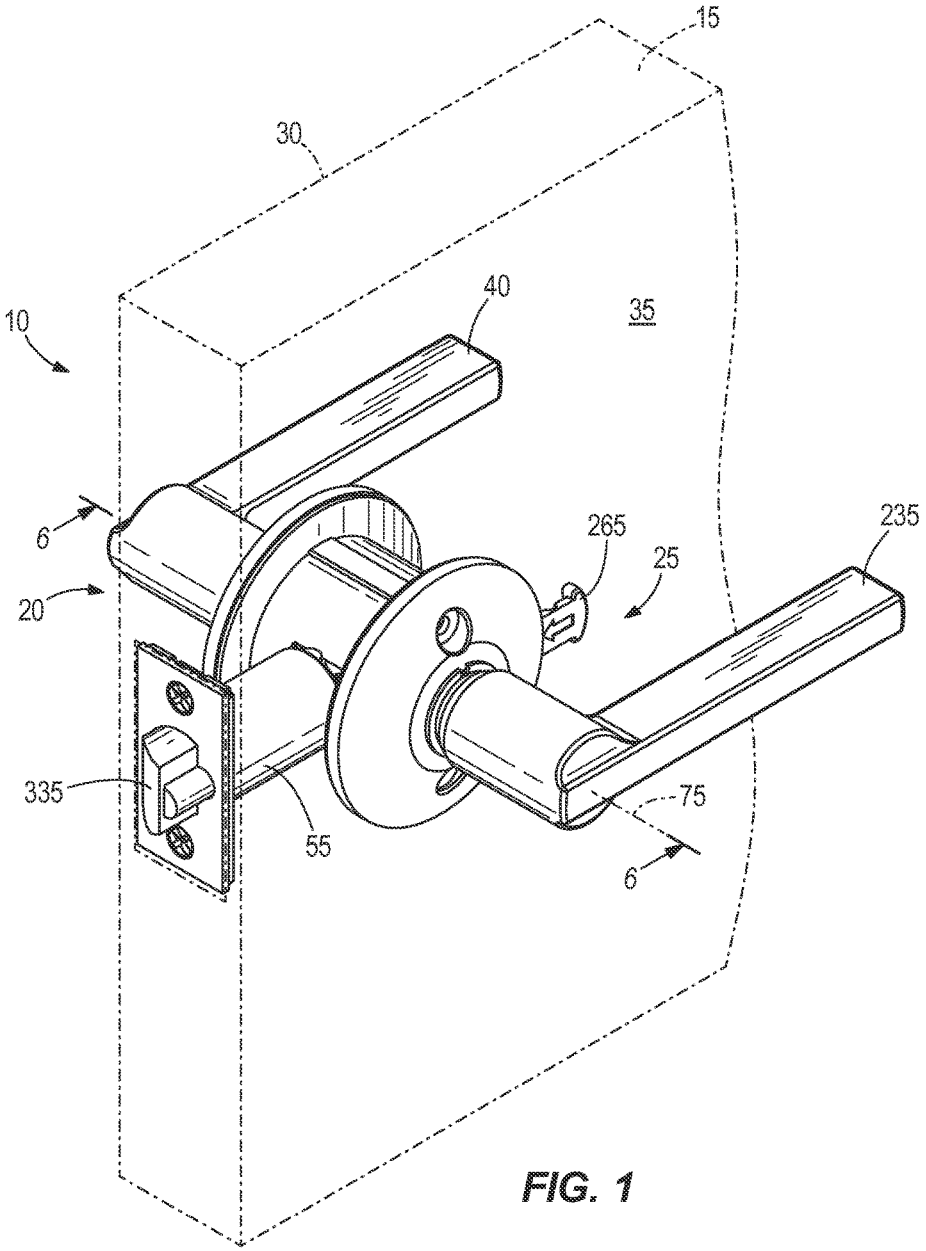
FIG. 1 is a perspective view of a door lock assembly including a privacy lock and having a rotational axis.

FIG. 1 illustrates a door lock assembly 10 that is attachable to a door 15. The door lock assembly 10 includes a first side assembly 20 and a second side assembly 25. In preferred arrangements, the first side assembly 20 is positioned on an outside surface 30 of the door 15 and the second side assembly 25 is positioned on an inside surface 35 of the door 15. The type of door lock 10 illustrated herein is typically used on an internal door 15 such that both surfaces 30, 35 are inside of a home or office. However, the term "outside" as used herein refers to an unsecured side of the door 15 while the term "inside" refers to the side of the door 15 that is secured by the door lock 10. For example, this type of door lock 10 is often used on bedroom doors 15 with the inside 35 of the door 15 facing the bedroom and the outside 30 of the door 15 facing the hallway or room outside of the bedroom.

Figure 2:
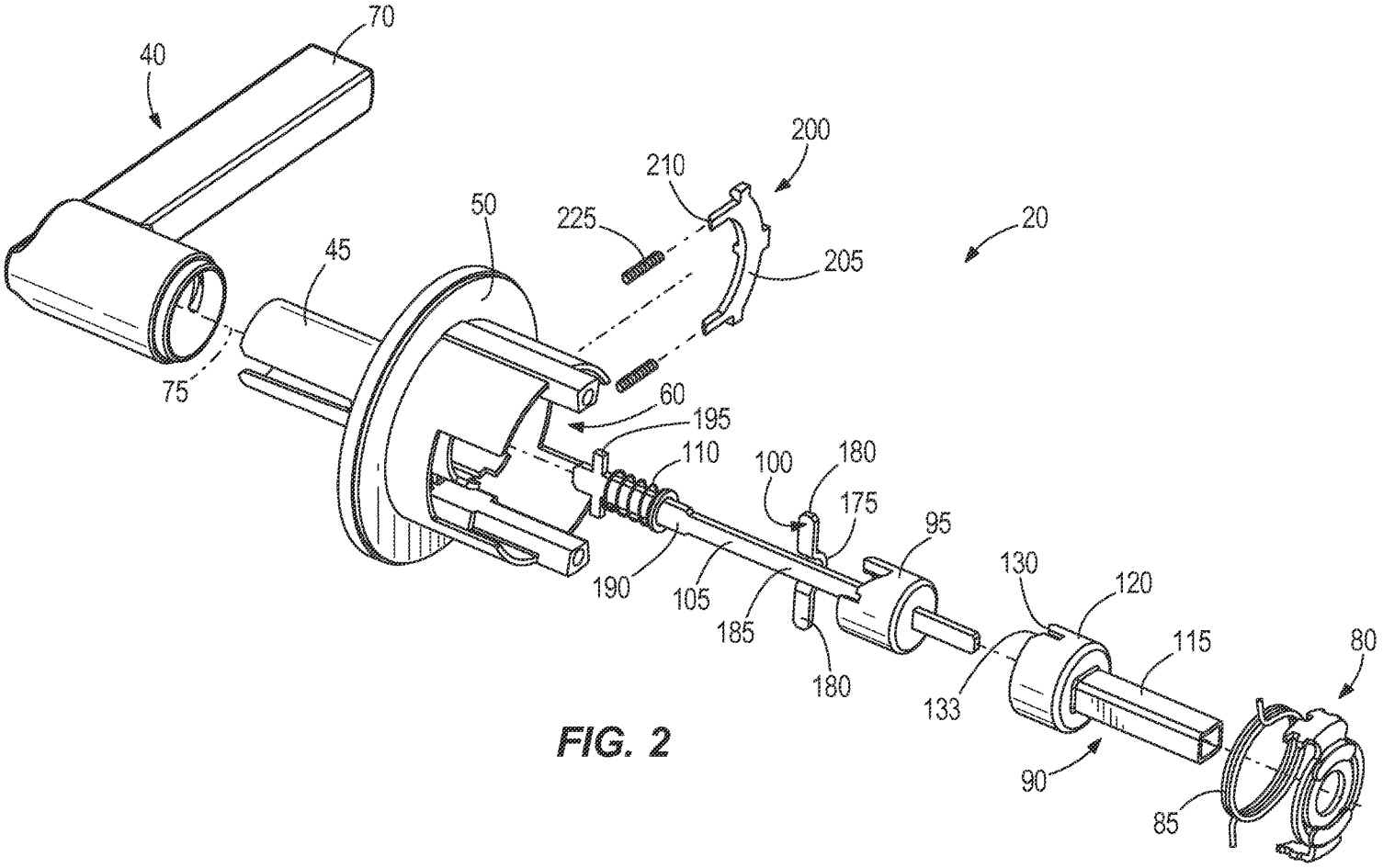
FIG. 2 is an exploded perspective view of a first side of the lock assembly of FIG. 1.
Figure 15:
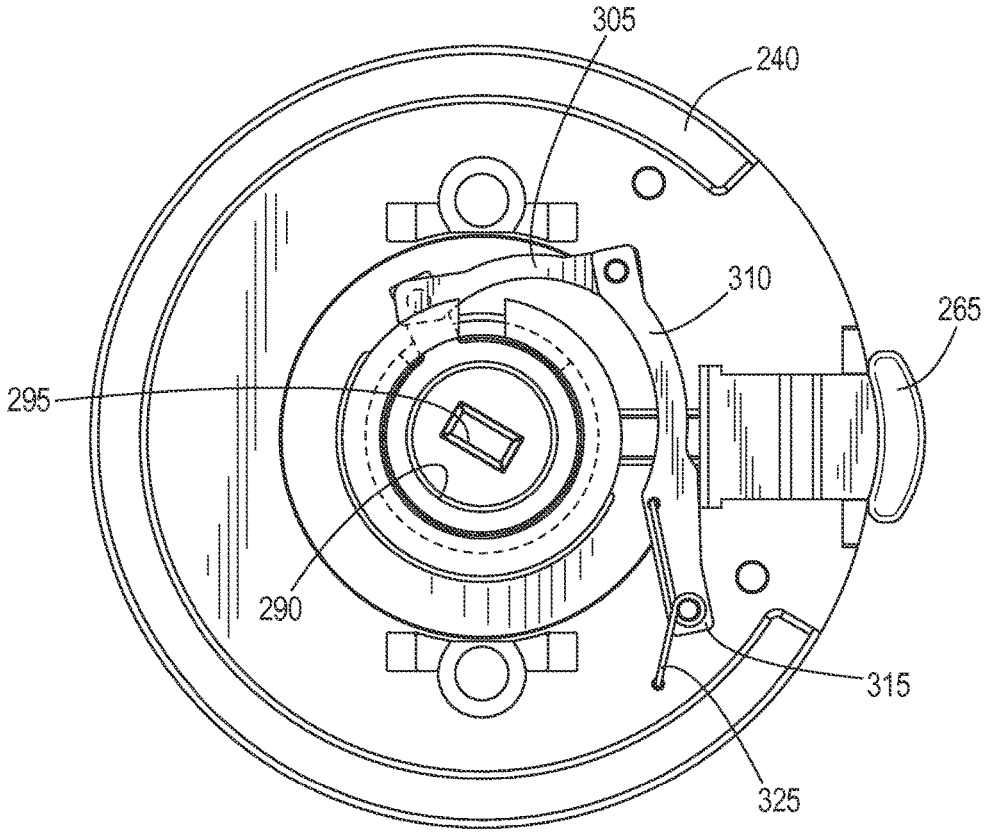
FIG. 15 is an end view of the inside assembly of FIG. 3.

As illustrated in FIG. 2, the outside assembly 20 includes an outside actuator 40, an outside spindle 45, an outside housing 50, and a lock mechanism 55. The outside housing 50 fixedly engages the door 15 and defines a space 60 that receives the outside spindle 45 and the lock mechanism 55. As illustrated in FIG. 15, the outside housing 50 also defines a pair of opposed slots 65 within the space 60.

The outside actuator 40 includes a lever 70, a door knob, or other handle that engages the spindle 45 to facilitate rotation of the outside spindle 45 about a rotational axis 75 to actuate the lock mechanism 55 and open the door 15. The outside assembly 20 also includes a lever return assembly 80 that operates to return the lever 75 to a neutral or centered position. In the illustrated construction, a torsional spring 85 returns the outside spindle 45 to the desired centered position with other arrangements being possible.

Figure 12:
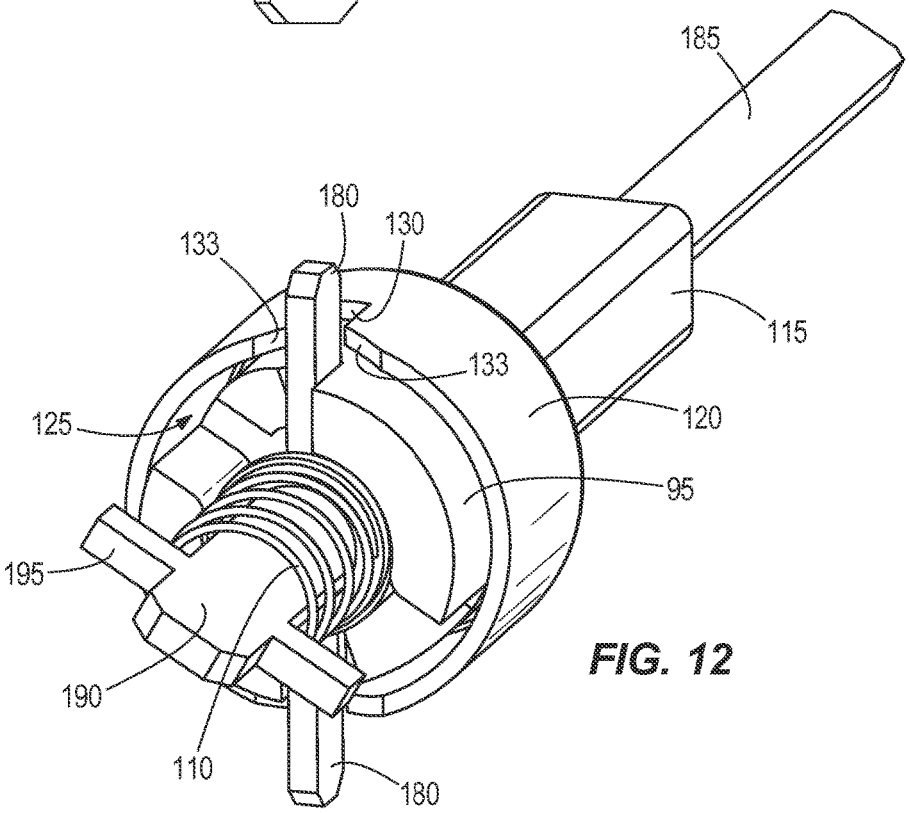
FIG. 12 is a perspective view of a portion of the lock assembly in an unlocked state.
Figure 13:
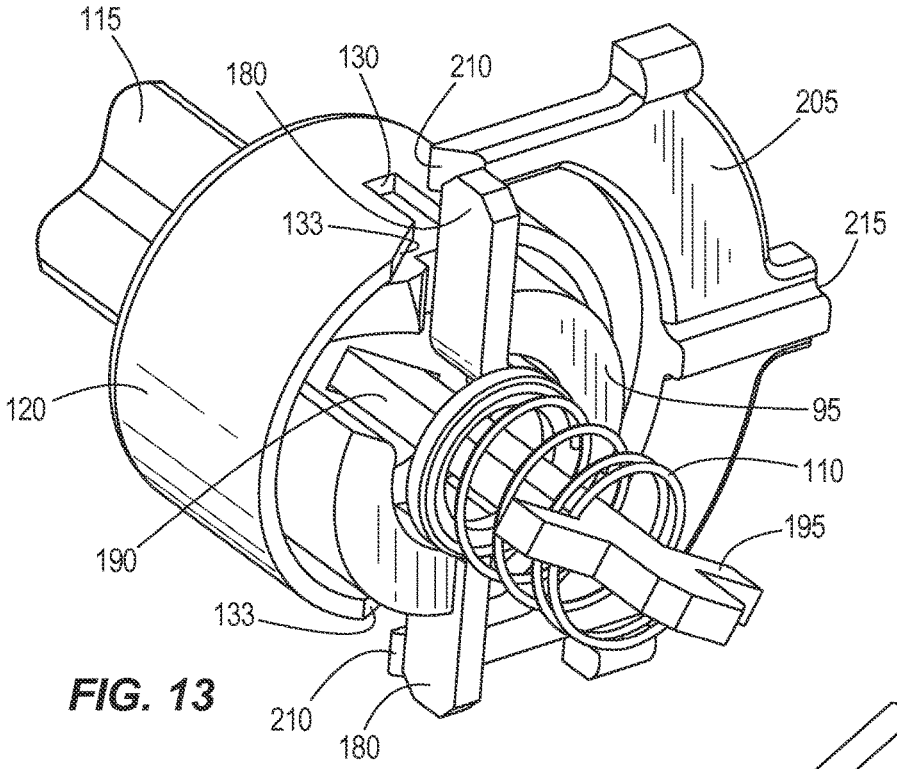
FIG. 13 is a perspective view of the portion of the lock assembly including the external unlock actuator of FIG. 8 in the engaged position.
Figure 14:
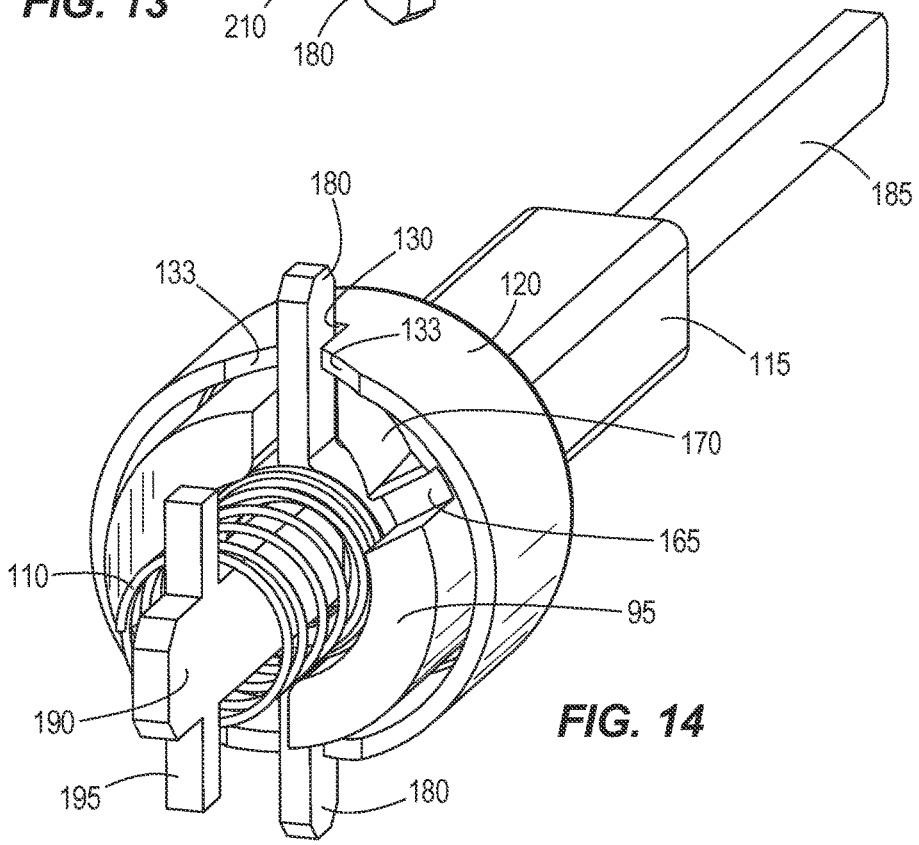
FIG. 14 is a perspective view of the portion of the lock assembly in the locked state.

The lock mechanism 55 includes a rectangular spindle 90, a cam 95, a locking plate 100, a plunger bar 105, and a biasing member 110. The rectangular spindle 90 includes a rectangular tube portion 115 that extends along a portion of the rotational axis 75. A cup portion 120 is coupled to one end of the tube portion 115 and includes an internal space 125 and a pair of opposed slots 130 (best shown in FIGS. 11-14). As is best illustrated in FIGS. 12-14, each of the slots 130 extends into the cup portion 120 in a direction substantially parallel to the rotational axis 75. Tapered edges 133 are formed in the cup 120 on either side of each of the slots 130.

Figure 5:
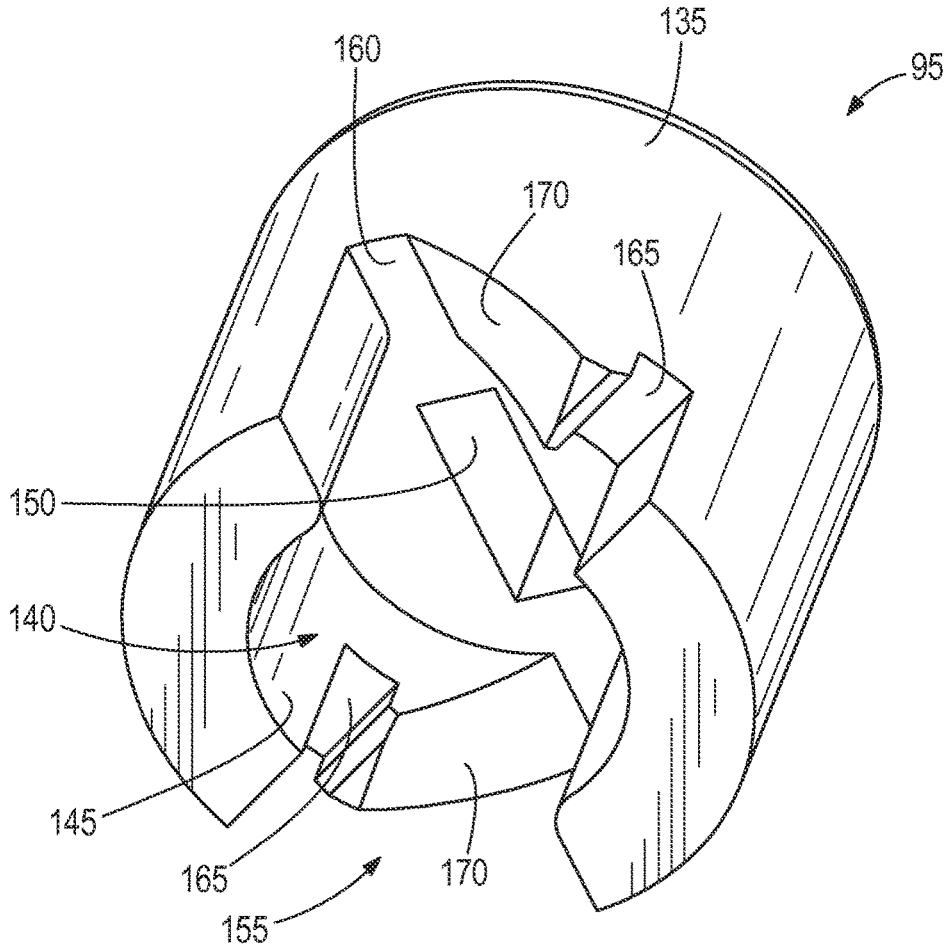
FIG. 5 is a perspective view of cam.

The cam 95, illustrated in FIG. 5 includes a substantially cylindrical body 135 sized to fit within the cup portion 120 of the rectangular spindle 90 and having a central aperture 140 passing there through. The central aperture 140 includes a top portion 145 that is substantially cylindrical or circular in cross-section and a lower portion 150 that has a non-circular cross-section with a rectangular cross-section being preferred. A pair of cut-outs 155 are formed about 180 degrees apart from one another and extend in a direction substantially parallel to the rotational axis 75 to a depth that is equal to or less than the depth of the top portion 145 of the central aperture 140. Each cut-out 155 includes a lower slot 160 and an upper slot 165 arranged such that the lower slots 160 are opposite one another and the upper slots 165 are opposite one another. Ramp surfaces 170 extend between the upper slot 165 and the lower slot 160 in each of the cut-outs 155.

With reference to FIG. 2, the locking plate 100 includes a central portion 175 that is a generally annular cylinder having an outside diameter that fits within the top portion 145 of the central aperture 140 and an inside diameter that is large enough to receive the plunger bar 105. Two arms 180 extend in opposite directions from the central portion 175 and are sized to fit within the upper slots 165, the lower slots 160, the opposed slots 130 of the cup 120, and the slots 65 of the outside housing 50. In the illustrated construction, each of the arms 180 is substantially rectangular in cross-section with other shapes and arrangements being possible.

The plunger bar 105 includes a first portion 185 that extends toward the inside assembly 25 and a second portion 190 that extends in the opposite direction. In the illustrated construction, both the first portion 185 and the second portion 190 are rectangular in cross-section with the first portion 185 having a smaller height than the second portion 190. A cross member 195 is positioned adjacent one end of the plunger bar 105 and acts as a stop for the biasing member 110. A second end of the biasing member 110 is arranged to engage the locking plate 100 to bias the locking plate 100 axially toward the inside assembly 25.

Figure 8:
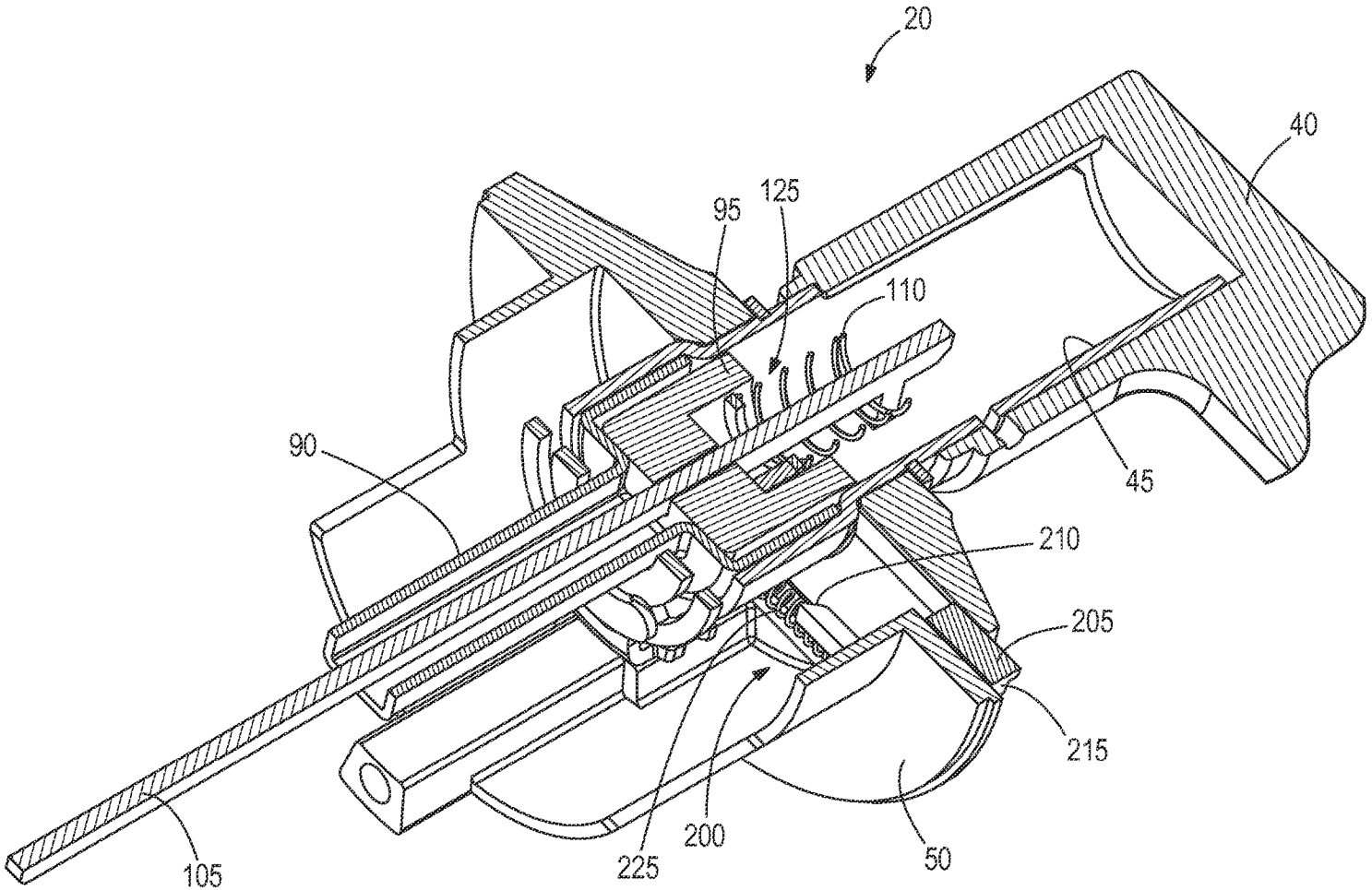
FIG. 8 is perspective section view taken along the rotational axis of the lock assembly showing a portion of an external unlock mechanism.
Figure 9:
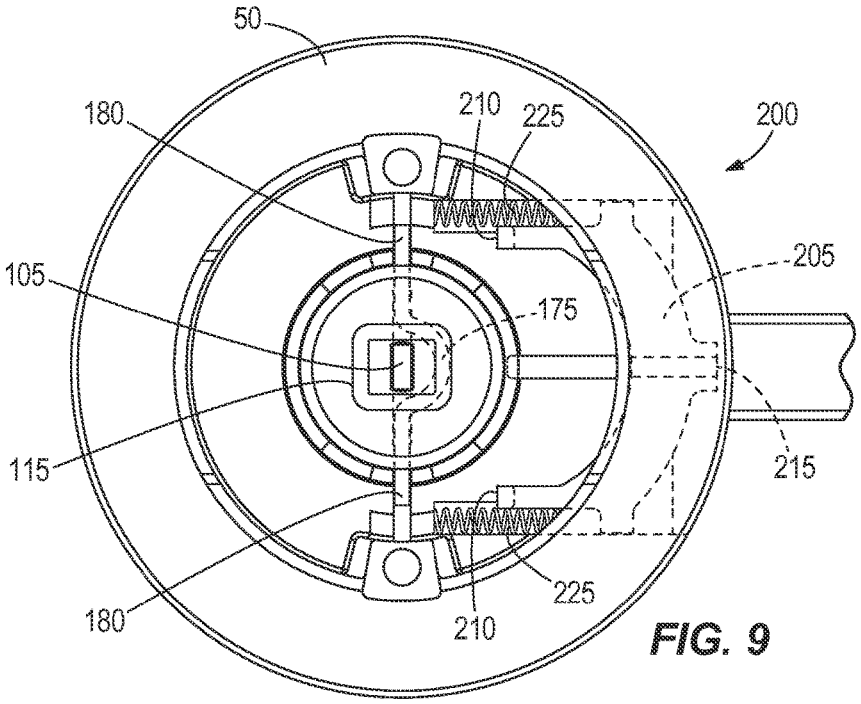
FIG. 9 is an end view of the first side of the of the lock assembly including an external unlock actuator in a disengaged position.
Figure 10:
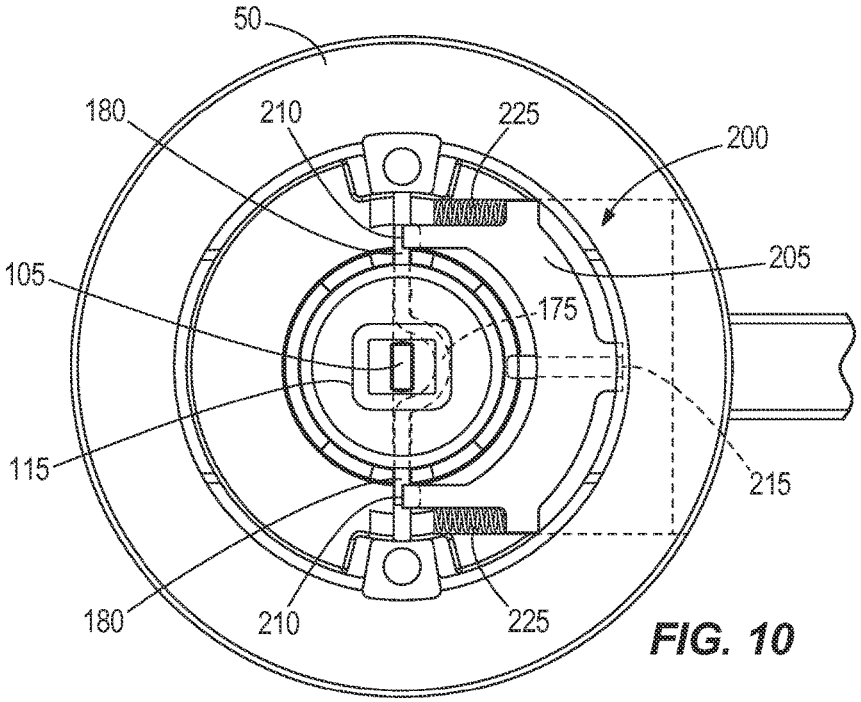
FIG. 10 is an end view of the first side of the of the lock assembly including the external unlock actuator in an engaged position.
Figure 11:
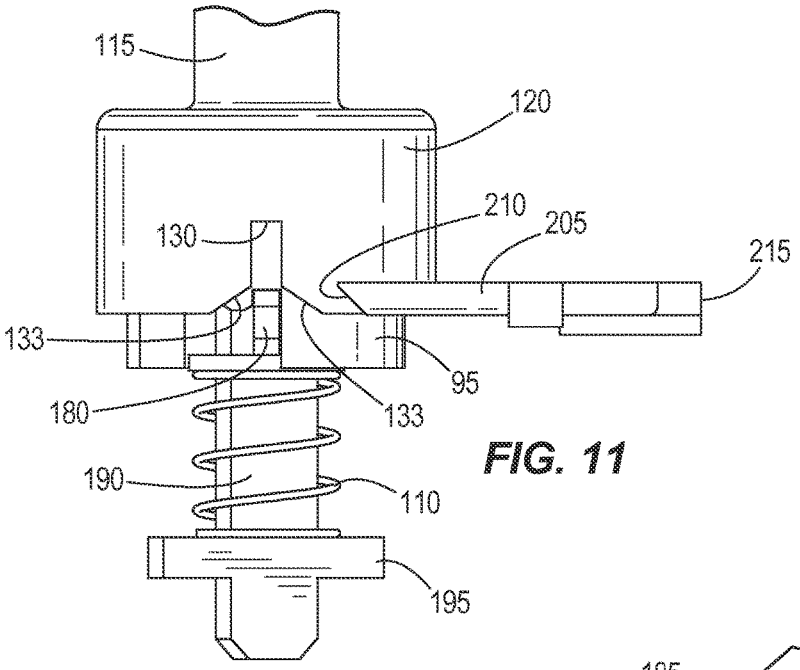
FIG. 11 is a top view of the first side of the of the lock assembly including the external unlock actuator in an disengaged position.

As illustrated in FIG. 8, the outside housing 50 supports an external unlock mechanism 200 that includes an external unlock actuator 205 supported by the outside housing 50 for movement in a direction substantially normal to the rotational axis 75 between a disengaged position and an engaged position. As is best illustrated in FIGS. 9 and 10, the external unlock actuator 205 is substantially C-shaped and includes two actuating tips 210 and a central engagement portion 215. The engagement portion 215 is positioned near an aperture 220 in the outside housing 50 to allow a user to move the external unlock actuator 205 using a pin or other properly sized instrument. A biasing spring 225 is positioned between the external unlock actuator 205 and the outside housing 50 to bias the actuator 205 toward the disengaged position.

Figure 3:
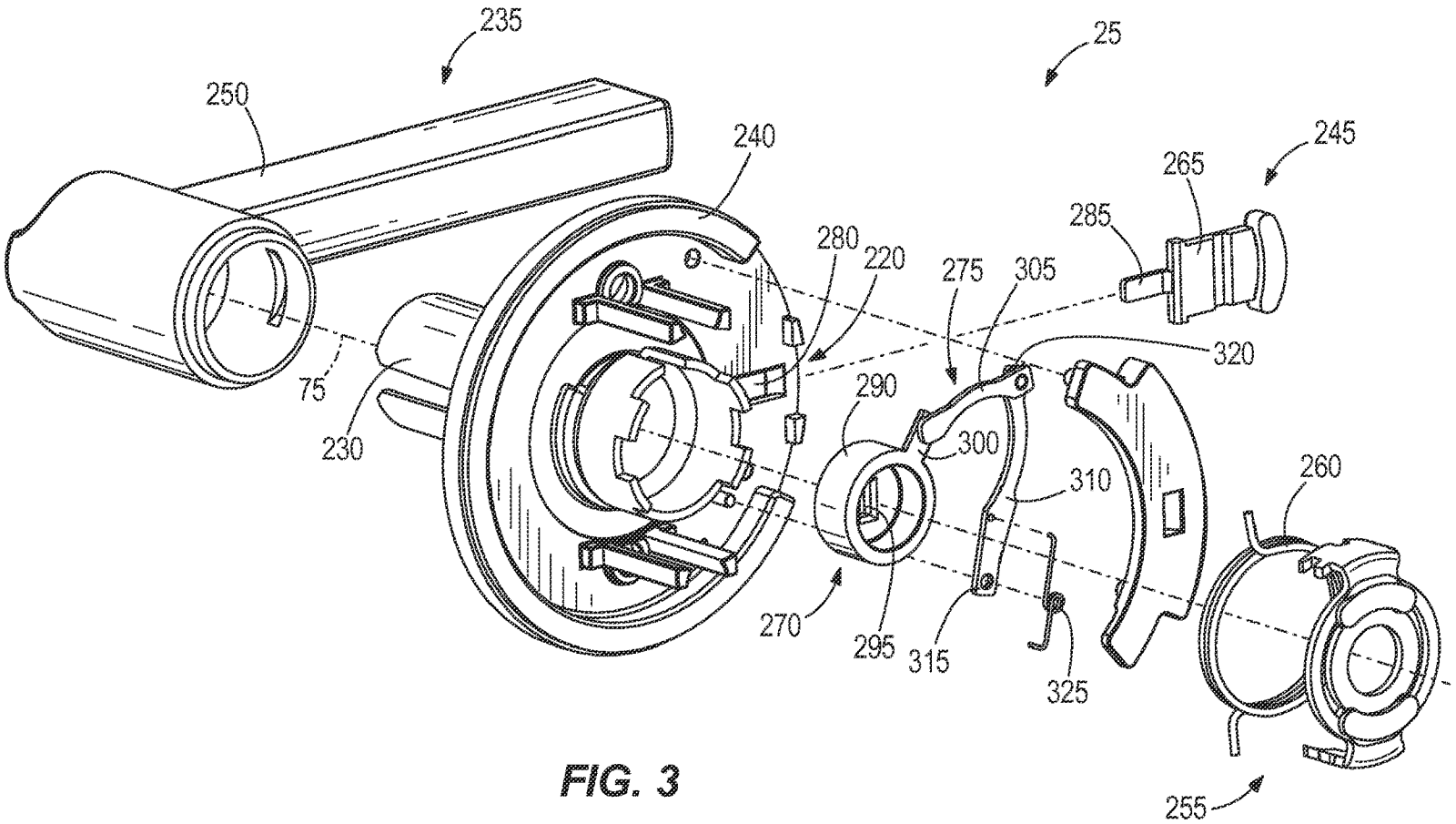
FIG. 3 is an exploded perspective view of a second side of the lock assembly of FIG. 1.

Turning to FIG. 3, the inside assembly 25 includes an inside spindle 230, an inside actuator 235, an inside housing 240, and a privacy lock actuation mechanism or privacy selector 245. The inside housing 240 fixedly engages the inside 35 of the door 15 and supports the inside spindle 230 and the privacy lock actuation mechanism or privacy selector 245. The inside actuator 235 includes a lever 250, a door knob, or other handle that engages the inside spindle 230 to facilitate rotation of the inside spindle 230 about the rotational axis 75 to actuate the lock mechanism 55 and open the door 15. The inside assembly 25 also includes a lever return assembly 255 that operates to return the lever 250 to a neutral or centered position. In the illustrated construction, a torsional spring 260 returns the inside spindle 230 to the desired centered position with other arrangements being possible.

The privacy lock actuation mechanism or privacy selector 245 of FIG. 3 includes a push button or privacy lock actuator 265, a locking link 270, and a linkage 275. The push button or privacy lock actuator 265 is supported by the inside housing 240 alone, or the inside housing 240 in cooperation with another component such as the door 15, for linear movement along an axis that is substantially normal to the rotational axis 75 of the door lock 10. The inside housing 240 may include a channel or other guide 280, as illustrated in FIG. 13, that engages a cooperating member 285 of the push button or privacy lock actuator 265 to guide the movement of the push button or privacy lock actuator 265 along a desired path.

The locking link 270 includes a cup-shaped body 290, an aperture 295 passing through the cup-shaped body 290, and a fixed link 300 extending outward from the cup-shaped body 290. The aperture 295 is positioned along the rotational axis 75 of the door lock 10 and is non-circular in cross-section with a rectangular cross-section being preferred. The fixed link 300 extends radially outward from the cup-shaped body 290 and provides an attachment point for the linkage 275.

In the construction illustrated in FIGS. 3 and 15, the linkage 275 includes a small link or connecting link 305 and a large link or rocker link 310. The large link or rocker link 310 includes a first end 315 that is pivotally attached to the inside housing 240 (or other component that is fixed with respect to the door 15) such that the large link or rocker link 310 is pivotable about the first end 315. A second end 320 of the large link or rocker link 310 attaches to a first end of the small link or connecting link 305 with a second end of the small link or connecting link 305 attaching to the fixed link 300 to complete the connection. The push button or privacy lock actuator 265 attaches to a point on the large link or rocker link 310 between the first end 315 and the second end 320 such that linear motion of the push button or privacy lock actuator 265 is converted to rotational movement of the large link or rocker link 310. The pivoting motion of the large link or rocker link 310 causes the second end 320 of the large link or rocker link 310, and the first end of the small link or connecting link 305 to move along an arc centered on the first end 315 of the large link or rocker link 310. The movement of the first end of the small link or connecting link 305 produces a corresponding movement of the second end of the small link or connecting link 305. The movement of the second end of the small link or connecting link 305 rotates the locking link 270 about the rotational axis 75. A biasing member 325 in the form of a torsional spring is coupled to the large link or rocker link 310 and the inside housing 240 to bias the large link or rocker link 310 toward a first orientation or position (typically, the unlocked position). In the illustrated construction, the biasing member 325 is coupled to the first end 315 of the large link or rocker link 310 with other constructions being possible. It should be noted that the terms "large link" and "small link" are used herein for convenience and clarity. However, it should be understood that the invention is not limited to designs in which the "large link or rocker link 310" is larger than the "small link or connecting link 305".

Figure 4:
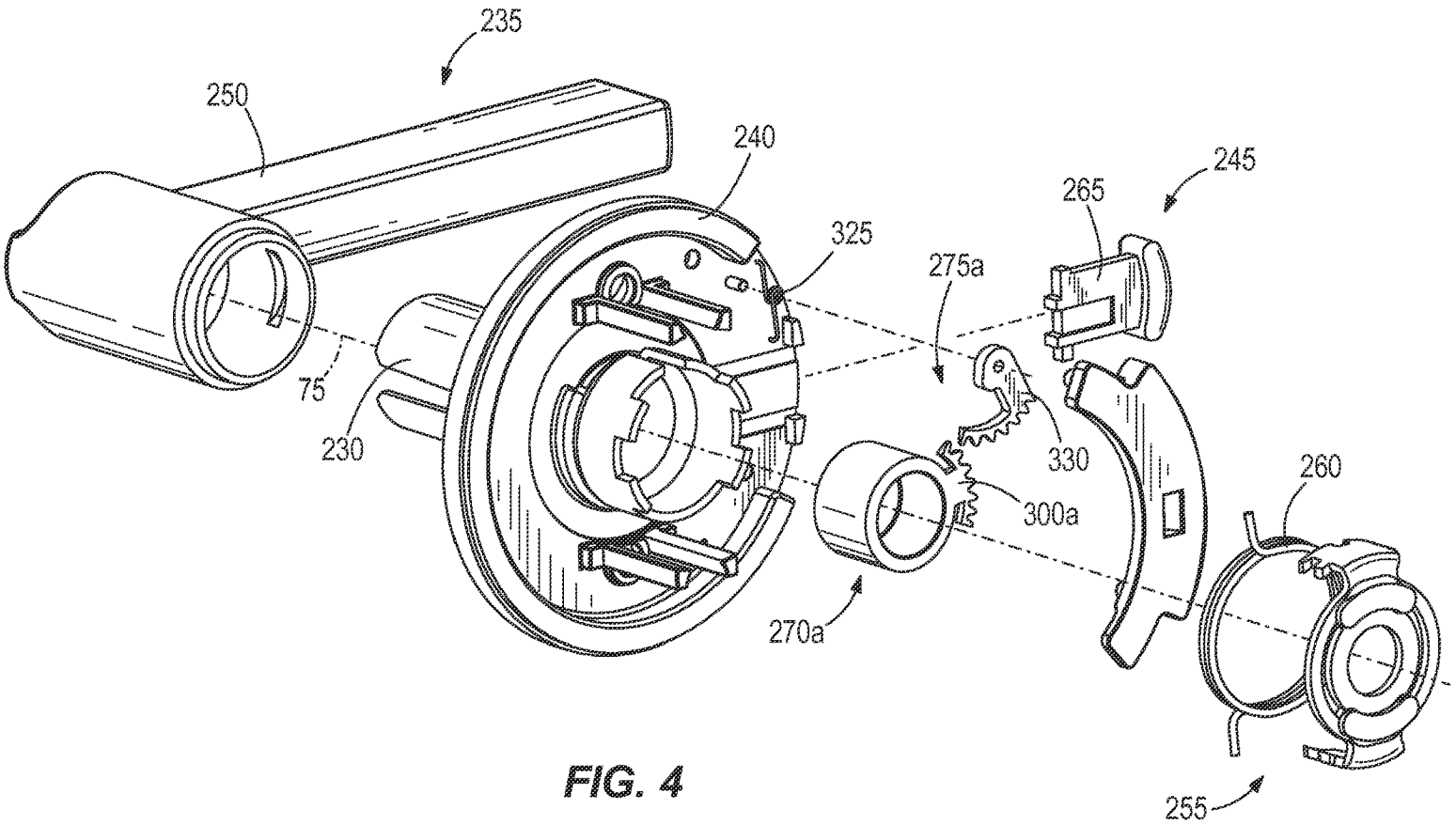
FIG. 4 is an exploded perspective view of another first side of a lock assembly.

FIG. 4 illustrates another arrangement of the linkage 275*a* that can be used with the door lock 10 of FIG. 1. In the construction of FIG. 4, the fixed link 300*a* includes a portion of a gear formed on an arc. A sector gear 330 includes another portion of a gear that is arranged to engage the portion of the gear formed as part of the fixed link 300*a*. The sector gear 330 is pivotally attached to the inside housing 240 (or another fixed component) and the push button or privacy lock actuator 265 engages the sector gear 330 such that axial movement of the push button or privacy lock actuator 265 is converted via the meshing gear portions to rotation of the locking link 270*a*. A biasing member could be provided to bias the sector gear 330 toward a predetermined position, typically the unlocked position.

Figure 6:
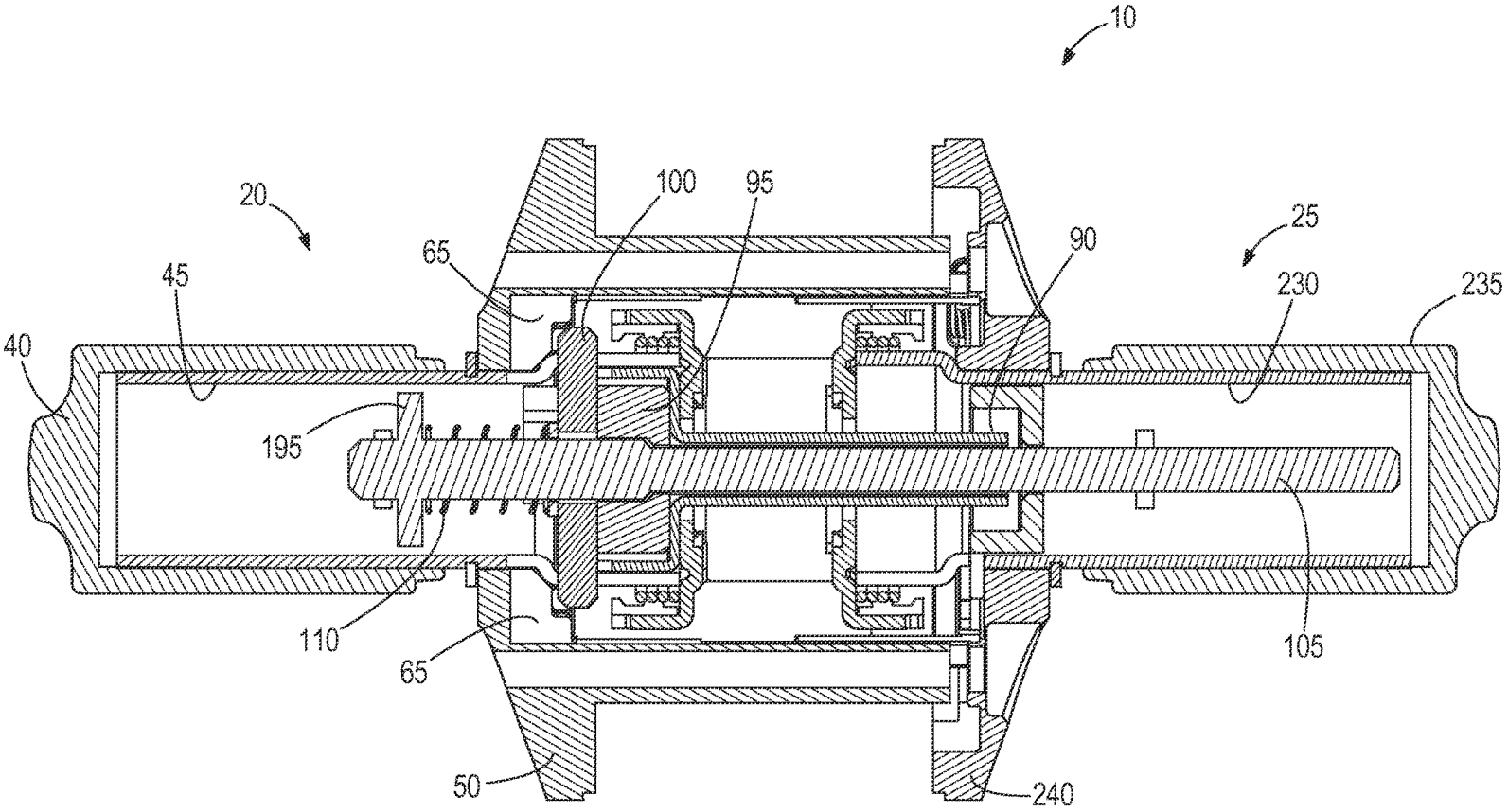
FIG. 6 is a section view taken along the rotational axis of the lock assembly with the privacy lock in an unlocked state.

With reference to FIG. 6, the assembly of the door lock 10 will now be described. The inside housing 240 and the outside housing 50 attach to one another with the door 15 sandwiched therebetween. The inside spindle 230 is rotationally coupled to the rectangular spindle 90 such that rotation of the inside spindle 230 produces a corresponding rotation of the rectangular spindle 90. The cam 95 is positioned within the cup portion 115 of the rectangular spindle 90 and the locking plate 100 is positioned within the cam 95 with the arms 180 extending out the cut-outs 155. The plunger bar 105 extends along the rotational axis 75 and passes through the cam 95, the rectangular spindle 90, and the locking link 270. The apertures 140, 295 of the cam 95 and the locking link 270 are shaped to closely engage the plunger bar 105, thereby coupling the plunger bar 105, the cam 95, and the locking link 270 for rotation. The outside spindle 45 extends around the cup portion 115 of the rectangular spindle 90 and the cam 95 and engages the locking plate 100 such that the locking plate 100 and the spindle 45 fixedly rotate with one another. A conventional mechanism, such as a latch assembly 335 shown in FIG. 1 is coupled to the rectangular spindle 90 such that rotation of the rectangular spindle 90 moves the latch assembly 335 and allows the door 10 to be opened.

In operation, a user can actuate the push button or privacy lock actuator 265 to move the privacy lock 245 from an unlocked state to a locked state. When in the unlocked state, as illustrated in FIGS. 6 and 12, the cam 95 is rotationally positioned such that the locking plate 100 is in the lower slot 160 of the cam 95. The biasing member 110 of the plunger bar 105 provides a biasing force that biases the locking plate 100 toward the lower slot 160. In this position, as illustrated in FIG. 6 the locking plate 100 is disengaged from the slots 65 of the outside housing 50 and is free to rotate with the outside spindle 45. Rotation of the outside spindle 45 produces a corresponding rotation of the rectangular spindle 90 to actuate the latch assembly 335 and allow the door 45 to open. Similarly, rotation of the inside spindle 230 produces rotation of the rectangular spindle 90 and opens the door 15.

Figure 7:
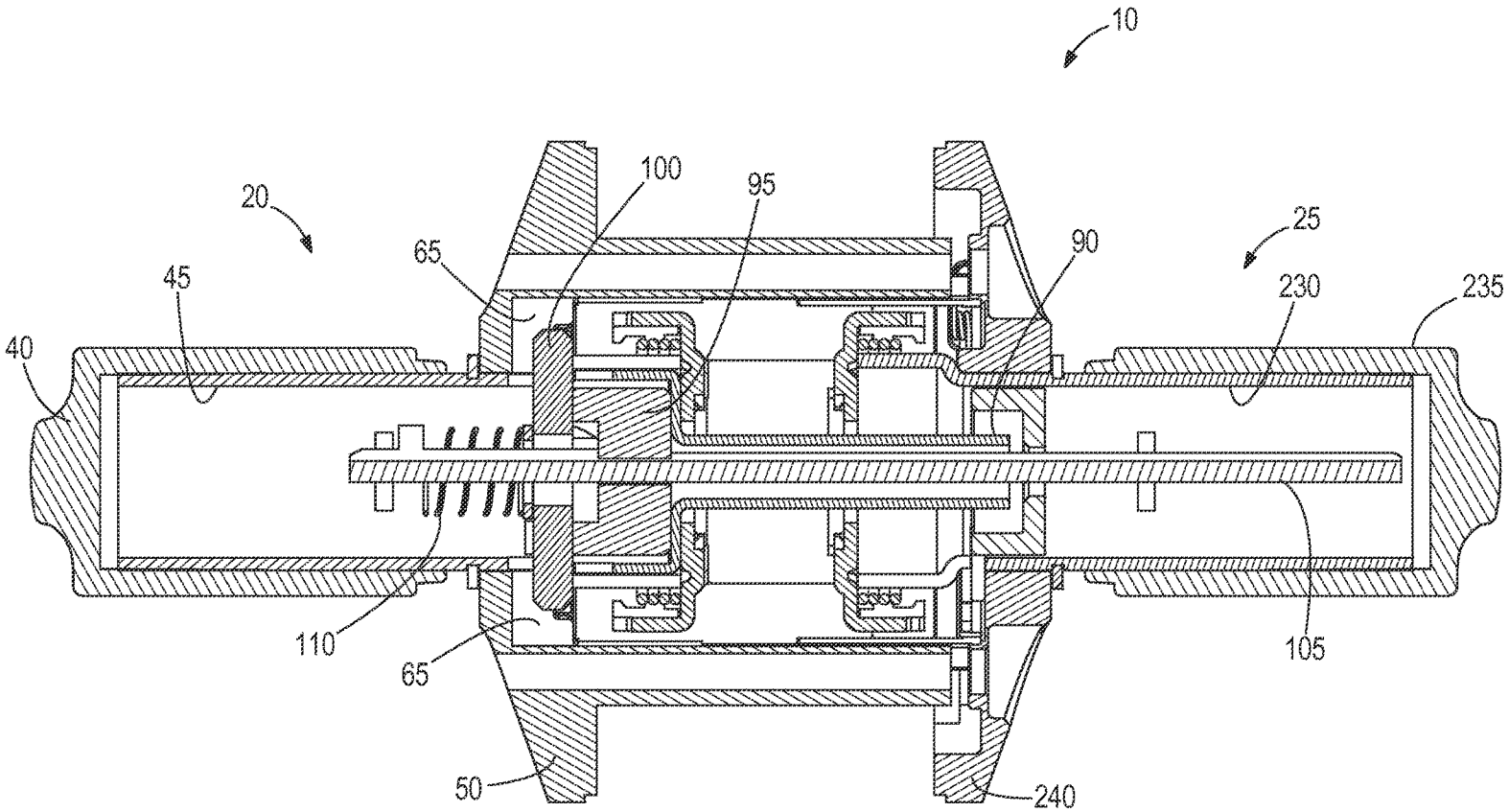
FIG. 7 is a perspective section view taken along the rotational axis of the lock assembly with the privacy lock in a locked state.

To engage the privacy lock 245, the user pushes the push button or privacy lock actuator 265 toward the rotational axis 75. The linear movement of the push button or privacy lock actuator 265 is converted to rotation of the locking link 270 by the linkage 275, 275*a*. Rotation of the locking link 270 forces a corresponding rotation of the plunger bar 105 and the cam 95. As the cam 95 rotates, the ramp surfaces 170 engage the locking plate 100 and force the locking plate 100 to move axially against the biasing member 110 toward the outside actuator 40 until the locking plate 100 engages the upper slot 165 of the cam 95 as illustrated in FIGS. 7 and 13. As illustrated in FIG. 7, the axial movement of the locking plate 100 moves the locking plate 100 into engagement with the slots 65 of the outside housing 50. Once engaged, the locking plate 100 and therefore the outside spindle 45 cannot be rotated and the latch assembly 335 cannot be actuated from the outside.

Once the privacy lock 245 is engaged, two ways are provided for its disengagement. First, the user can rotate the inside spindle 230. Rotation of the inside spindle 230 rotates the rectangular spindle 90 which actuates the latch assembly 335 to open the door 15 as has been described. However, rotation of the rectangular spindle 90 also rotates the tapered edges 133 of the cup portion 120 of the rectangular spindle 90 into engagement with the locking plate 100 and displaces the locking plate 100 axially until it is lifted out of the upper slot 165. A biasing force provided by the torsional spring 325 or another biasing member rotates the locking link 270, the plunger bar 105, and the cam 95 toward the unlocked position while the biasing member 110 biases the locking plate 100 axially away from the outside actuator 40 and into the lower slot 160 of the cam 95. Once in the lower slot 160, the locking plate 100 is disengaged from the outside housing 50 and the outside spindle 45 can be rotated to actuate the latch assembly 335 and open the door 15.

Alternatively, a user can disengage the privacy lock 245 from the outside using the external unlock mechanism 200. The user inserts a pin or other properly sized instrument into the aperture 220 of the outside housing 50 to contact the external unlock actuator 205 and displace the actuator 205 axially from the position illustrated in FIG. 9 toward the position illustrated in FIGS. 10 and 14. As the actuator 205 is displaced, the actuating tips 210 engage the arms 180 of the locking plate 100 and displace the locking plate 100 axially toward the outside actuator 40. The biasing force provided by the torsional spring 325 rotates the locking link 270, the plunger bar 105, and the cam 95 toward the unlocked position. As the user removes the instrument, the biasing member 325 or another unlock biasing spring biases the external unlock actuator 205 toward the disengaged position. Once the actuator 205 is sufficiently retracted, the biasing member 110 biases the locking plate 100 axially away from the outside actuator 50 and into the lower slot 160 of the cam 95. Once in the lower slot 160, the locking plate 100 is disengaged from the outside housing 50 and the outside spindle 45 can be rotated to actuate the latch assembly 335 and open the door 15.

Various features and advantages of the invention are set forth in the following claims.

What is claimed is:

1. A door lock for a door that separates an inside from an outside and that includes a privacy function, the door lock comprising:

a latch assembly positioned at least partially within the door and movable between an engaged position in which the door is held in a closed position and a disengaged position in which the door is movable from the closed position to an open position;

an inside housing fixedly coupled to an inside surface of the door;

an outside housing fixedly coupled to an outside surface of the door;

an outside actuator rotatable about an axis to selectively move the latch assembly between the engaged position and the disengaged position;

an inside actuator rotatable about the axis to selectively move the latch assembly between the engaged position and the disengaged position;

a privacy selector extending from the inside housing and including a privacy lock actuator movable in a linear direction normal to the axis to vary the privacy selector between an open position and a privacy position;

a cam member coupled to the privacy selector such that the cam member rotates between an unlocked position and a locked position in response to axial movement of the privacy selector between the open position and the privacy position; and a locking plate coupled to the cam and movable along the axis between a disengaged position and an engaged position in response to rotation of the cam between the unlocked position and the locked position, wherein the locking plate engages the outside housing when in the locked position, and wherein when the privacy selector is in the open position the privacy selector allows the outside actuator to actuate the latch assembly between the engaged position and the disengaged position and when in the privacy position the privacy selector inhibits the outside actuator from actuating the latch assembly towards the disengaged position with respect to the outside housing, and wherein rotation of the inside actuator moves the privacy selector from the privacy position to the open position and actuates the latch assembly toward the disengaged position.

2. The door lock of claim 1, further comprising a plunger bar that extends from the inside housing to the outside housing along the axis, and wherein rotation of the plunger bar about the axis from a first position to a second position inhibits movement of the outside actuator.

3. The door lock of claim 2, wherein the privacy selector further includes a linkage interconnecting the privacy lock actuator and the plunger bar.

4. The door lock of claim 3, wherein the linkage is arranged to convert linear motion of the privacy lock actuator into rotary motion of the plunger bar.

5. The door lock of claim 3, wherein the linkage includes a locking link rotatably coupled to the plunger bar, a rocker link connected to the privacy lock actuator, and a connecting link coupled to the rocker link and the locking link.

6. The door lock of claim 5, wherein the rocker link includes a first end pivotally connected to the inside housing and a second end connected to the connecting link, wherein the rocker link is pivotable about a pivot axis that is substantially parallel to the axis.

7. The door lock of claim 6, further comprising a biasing member coupled to the inside housing and the rocker link to bias the rocker link toward the open position.

8. The door lock of claim 3, wherein the linkage includes a locking link rotatably coupled to the plunger bar and a first sector gear connected to the locking link and the privacy lock actuator.

9. The door lock of claim 8, wherein the locking link includes a second sector gear in a meshed relationship with the first sector gear.

10. The door lock of claim 1, further comprising an outside release mechanism coupled to the outside housing and movable in a direction substantially normal to the axis to move the privacy selector from the privacy position to the open position from outside of the door.

11. A door lock for a door that separates an inside from an outside and that includes a privacy function, the door lock comprising:

a latch assembly positioned at least partially within the door and movable between an engaged position in which the door is held in a closed position and a disengaged position in which the door is movable from a closed position to an open position;

an outside spindle rotatable about an axis;

an inside spindle rotatable about the axis to move the latch assembly between the engaged position and the disengaged position;

a locking plate movable along the axis between a locked position in which the outside spindle is fixed with respect to the axis and an unlocked position in which the outside spindle and the inside spindle are each rotatable about the axis to move the latch assembly;

a cam member rotatable between an unlocked position and a locked position to move the locking plate between the locking plate locked position and the locking plate unlocked position; and a privacy lock actuator positioned on the inside of the door and movable in a linear direction substantially normal to the axis to rotate the cam member and thereby move the locking plate between the locked position in which the privacy lock actuator inhibits the outside spindle from moving the latch assembly to the disengaged position and the unlocked position in which the privacy lock actuator allows the outside spindle to move the latch assembly between the engaged position and the disengaged position, and wherein rotation of the inside actuator moves the locking plate from the locked position to the disengaged position and moves the latch assembly toward the disengaged position.

12. The door lock of claim 11, further comprising a plunger bar that extends from the inside housing to the outside housing along the axis, and wherein rotation of the plunger bar about the axis moves the locking plate from the unlocked position to the locked position.

13. The door lock of claim 12, further comprising a linkage interconnecting the privacy lock actuator and the plunger bar, wherein the linkage is arranged to convert linear motion of the privacy lock actuator into rotary motion of the plunger bar.

14. The door lock of claim 13, wherein the linkage includes a locking link rotatably coupled to the plunger bar, a rocker link connected to the privacy lock actuator, and a connecting link coupled to the rocker link and the locking link.

15. The door lock of claim 14, wherein the rocker link includes a first end connected to the inside housing and a second end connected to the connecting link, wherein the rocker link is pivotable about a pivot axis that is substantially parallel to the axis.

16. The door lock of claim 15, further comprising a biasing member coupled to the inside housing and the rocker link to bias the rocker link toward the open position.

17. The door lock of claim 13, wherein the linkage includes a locking link rotatably coupled to the plunger bar and a first sector gear connected to the locking link and the privacy lock actuator.

18. The door lock of claim 17, wherein the locking link includes a second sector gear in a meshed relationship with the first sector gear.

19. The door lock of claim 11, further comprising an outside release mechanism coupled to the outside housing and movable in a direction substantially normal to the axis to move a privacy selector from a privacy position to the open position from outside of the door.

20. A door lock for a door that separates an inside from an outside and that includes a privacy function, the door lock comprising:

a latch assembly positioned at least partially within the door and movable between an engaged position in which the door is held in a closed position and a disengaged position in which the door is movable from a closed position to an open position;

an inside housing fixedly coupled to an inside surface of the door;

an outside housing fixedly coupled to an outside surface of the door;

a privacy locking mechanism disposed substantially within the outside housing such that a substantial portion of the privacy locking mechanism is disposed nearer to the outside surface of the door than to the inside surface of the door, the privacy locking mechanism operable in an open position in which the privacy locking mechanism allows operation of the latch assembly from inside and outside of the door to move the latch assembly between the engaged position and the disengaged position and a privacy position in which the privacy locking mechanism inhibits operation of the latch assembly towards the disengaged position from outside of the door; and a privacy selector extending from the inside housing and movable in a linear direction substantially parallel to the inside surface of the door to move the privacy locking mechanism between the open position and the privacy position, wherein movement of the latch assembly from inside of the door toward the disengaged position moves the privacy locking mechanism from the privacy position toward the open position, and wherein the privacy locking mechanism includes a cam member that rotates in response to movement of the privacy selector, and a locking plate that moves along an axis that is normal to the direction of movement of the privacy selector, the locking plate engaging the outside housing when privacy locking mechanism is in the privacy position.

21. A method of converting a privacy lock for a door to a passage lock, the method comprising:

connecting a lock housing to the door;

providing a latch assembly positioned at least partially within the door and movable between an engaged position in which the door is held in a closed position and a disengaged position in which the door is movable from a closed position to an open position;

positioning a privacy locking mechanism substantially within the lock housing, the privacy locking mechanism operable in an open position to allow operation of the latch assembly from inside and outside of the door and a privacy position in which operation of the latch assembly from outside of the door is inhibited;

connecting a privacy selector to the privacy locking mechanism, the privacy selector including a selector interface disposed substantially outside of the lock housing and movable to move the privacy locking mechanism to one of the privacy position and the open position; and removing the selector interface from the privacy selector to prevent a user from moving the privacy locking mechanism from the open position to the privacy position.

22. The door lock of claim 1, wherein the inside actuator is rotatable about the axis when the privacy selector is in the open position and when the privacy selector is in the privacy position.

* * * * *